US010024054B2

(12) United States Patent
Egli et al.

(10) Patent No.: US 10,024,054 B2
(45) Date of Patent: Jul. 17, 2018

(54) FACADE CONSTRUCTION

(71) Applicant: ROCKWOOL INTERNATIONAL A/S, Hedehusene (DK)

(72) Inventors: Christoph Egli, Flums (CH); Franz Kainz, Flums (CH)

( * ) Notice: Subject to any disclaimer, the term of this patent is extended or adjusted under 35 U.S.C. 154(b) by 0 days.

(21) Appl. No.: 15/307,947

(22) PCT Filed: Apr. 29, 2015

(86) PCT No.: PCT/CH2015/000068
§ 371 (c)(1),
(2) Date: Nov. 17, 2016

(87) PCT Pub. No.: WO2015/164987
PCT Pub. Date: Nov. 5, 2015

(65) Prior Publication Data
US 2017/0081849 A1 Mar. 23, 2017

(30) Foreign Application Priority Data
Apr. 30, 2014 (CH) ..... 0646/14

(51) Int. Cl.
*E04B 2/96* (2006.01)
*E04F 13/04* (2006.01)
(Continued)

(52) U.S. Cl.
CPC ..... *E04B 2/965* (2013.01); *E04B 1/7604* (2013.01); *E04B 1/7629* (2013.01);
(Continued)

(58) Field of Classification Search
CPC ..... E04F 13/04; E04B 1/76; E04B 1/7604; E04B 1/7629; E04B 1/7675; E04B 1/78; E04B 1/7608; E04B 2/965; E04B 2/96
See application file for complete search history.

(56) References Cited

U.S. PATENT DOCUMENTS 4,545,163 A * 10/1985 Asselin ..... E04B 2/84 249/213
8,898,984 B2 * 12/2014 Winteler ..... E04F 13/045 52/404.1

FOREIGN PATENT DOCUMENTS

CA 2786790 A1 * 7/2011 ..... E04F 13/045
DE 2201621 A1 * 7/1973 ..... E04F 13/0807
(Continued)

OTHER PUBLICATIONS

"WDKPHOENIX H Die warmebruckenfreie Unterkonstruktion Vorlagen 140-400 mm", May 1, 2013, pp. 1-20, XP055125461, retrieved from the intemet: URL: http://www.wagnersystem.ch/fileadmin/pdf/doku2012/01_04_1305Phoenix_H.pdf.

*Primary Examiner* — Beth A Stephan
(74) *Attorney, Agent, or Firm* — Morriss O'Bryant; Compagni Cannon, PLLC

(57) ABSTRACT

The invention relates to a facade construction comprising first thermal barrier elements which are arranged on a supporting framework, in particular of an outer wall of a building, second thermal barrier elements which are arranged on the first thermal barrier elements and a retaining device which is arranged on the supporting framework and holds the first and second thermal barrier elements on the supporting framework. The facade device further comprises an intermediate layer in the form of a multiplicity of mounting plates, which intermediate layer is attached to and supported by the retaining device, wherein the second thermal barrier elements are arranged on the intermediate layer.

17 Claims, 3 Drawing Sheets

(51) Int. Cl.
*E04B 1/76* (2006.01)
*E04B 1/78* (2006.01)
*E04F 13/08* (2006.01)

(52) U.S. Cl.
CPC ..... *E04B 1/7675* (2013.01); *E04B 1/78* (2013.01); *E04F 13/04* (2013.01); *E04B 2001/7679* (2013.01); *E04F 13/0807* (2013.01)

(56) References Cited

FOREIGN PATENT DOCUMENTS

| | | | | | |
|---|---|---|---|---|---|
| DE | 2849727 | A1 * | 5/1980 | ..... | E04F 13/0853 |
| DE | 3213899 | A1 * | 10/1983 | ..... | E04F 13/0853 |
| DE | 3407867 | | 9/1985 | | |
| DE | 3407867 | A1 * | 9/1985 | ..... | E04B 2/8635 |
| EP | 0026495 | A2 * | 4/1981 | ..... | E04F 13/0808 |
| EP | 2180115 | | 4/2010 | | |
| WO | 2011085507 | | 7/2011 | | |
| WO | WO 2011085507 | A1 * | 7/2011 | ..... | E04F 13/045 |

* cited by examiner

FACADE CONSTRUCTION

CROSS-REFERENCE TO RELATED APPLICATIONS

This application is a national phase entry under 35 U.S.C. § 371 of PCT/CH2015/000068 filed on Apr. 29, 2015, which claims priority to Swiss Patent Application 646/14 filed on Apr. 30, 2014, the entirety of each of which is incorporated by this reference.

FIELD OF THE INVENTION

The invention relates to a facade construction and to a method for assembling a facade construction.

PRIOR ART

A facade construction is known from the prior art (WO 2011/085507) having first and second thermal insulation panels which are held one above the other on an outer wall of a building by a retaining device. The retaining device comprises a spacer having a first end and a second end. At the first end the spacer is attached to the outer wall of a building and a supporting rail with a T-shaped cross-section is attached to the second end. The first thermal insulation panels are clamped between spacers located one above the other. The second thermal insulation panels are hung between two supporting rails located one above the other. For this purpose the second thermal insulation panels have grooves at their horizontally oriented sides, into which grooves the webs of the supporting rails latch.

This facade construction has very good thermal insulation properties but can only be assembled with a relatively high time expenditure for the following reasons: each second other thermal insulation panel has to be hung between two supporting rails located one above the other. For this purpose the second thermal insulation panel has to be provided with grooves at least on its horizontal sides. It must also be assembled very exactly since the spacing of supporting rails located one above the other must match the height of the second thermal insulation panels. Furthermore, the supporting rails must be screwed or riveted to the spacers.

DE 3407867 discloses a prefabricated wall element for prefabricated houses. The prefabricated wall elements are suitable for prefabricated houses of any kind having heat recovery systems. The wall element has a first formliner and a second formliner which are held parallel to each other with the aid of spacers. Mounted on the outer side of the second formliner are a foam panel and battens which project beyond the foam panel. A thermal insulation panel is attached to the battens. The battens projecting beyond the foam panel separate the foam panel from the thermal insulation panel, forming an airflow layer. The thermal insulation panel is made of a chipboard panel, designed as a retaining panel, and a foam layer affixed thereto. The thermal insulation panel can have an outer coating, such as a base render with reinforcement fabric. Air can flow for the purpose of heat recovery as a result of the airflow layer formed between the outer face of the foam panel and the thermal insulation panel. The airflow layer is a fundamental component of this disclosure, in particular that the airflow layer is sealed on both sides by the foam panel and the thermal insulation panel. This enables air to be conducted in the airflow layer without this radiating heat at walls of rooms which are not to be heated. The dissipated heat is fed to a heat recovery system.

The product documentation relating to a thermal bridge-free sub-structure belonging to Wagner Systems AG, which is marketed as the Phoenix facade system, describes a thermal insulation panel for a rear-ventilated facade system. The thermal insulation panel is made of a metal bracket used for anchoring to an outer wall of a building, and a strut made of glass fibre-reinforced plastics material, whose length matches the thickness of the insulating material.

The panel strut has a slot provided on its end face remote from the outer wall of a building, in which slot a supporting profile can be held at continuously adjustable spacings from the outer wall of a building.

Advantage of the Invention

An advantage of the invention is to improve the above-described facade construction by making it possible to assemble it more quickly.

SUMMARY OF THE INVENTION

The improved facade construction comprises first thermal insulation elements which are arranged on an outer wall of a building. Second thermal insulation elements are arranged on the first thermal insulation elements. A retaining device is arranged on the outer wall of a building, and this holds the first and second thermal insulation elements on the outer wall of a building.

According to the invention the advantages are achieved with a facade construction comprising an intermediate layer in the form of a plurality of mounting plates, which intermediate layer is attached to and supported by the retaining device. The second thermal insulation elements are arranged on the intermediate layer. The mounting plates have the advantage that they themselves can be attached quickly to the supporting rails and that the second thermal insulation elements can be quickly attached to their free surface. For particularly quick assembly of the facade construction it is conceivable to make the attachments using nails and a nail gun. The facade construction can be assembled particularly quickly as a result of this attaching option, although, compared to the prior art, additional mounting plates have to be mounted. The second thermal insulation elements do not require circumferential grooves in order to be mounted since they can be nailed to the mounting plates.

In one embodiment the plurality of mounting plates are attached side by side on the retaining device, whereby they form a mounting surface for the second thermal insulation elements. Geometric conditions of the substrate do not have to be heeded therefore during mounting of the second thermal insulation elements. The dimensions of the second thermal insulation elements, in particular second thermal insulation panels, do not have to be adapted to the sub-substructure either since they are placed on a plane surface.

The first thermal insulation elements expediently rest on the outer wall of a building and on the intermediate layer, whereby the facade construction is substantially free of rear ventilation. The facade construction is designed as a thermal insulation composite system and not as a curtained rear ventilation facade. Because there is no rear ventilation with the facade construction according to the invention, it is not necessary for the first thermal insulation elements to be able to absorb mechanical forces. The choice of first thermal insulation elements should therefore only be made after specifying the optimization of the thermal insulation and can be freely made accordingly. The present facade construction has a permeable structure. Rear ventilation for the removal of moisture is not necessary for this reason as well. A further advantage of a rear ventilation-free facade construction is that no additional sub-structure, for example wooden slats, is required to produce a rear ventilation channel. The facade construction can therefore be assembled quickly. A further advantage of the facade construction is that it can be assembled without glued joints between the individual layers and can therefore be completed quickly. The forces are deflected by way of the retaining devices used, the attached mounting plates and in combination with mechanical fastening elements, continuously from the outer thermal insulation elements into the outer wall of a building. In this respect, substantially without taking into account the mechanical properties of the thermal insulation elements. Complex and expensive covering of the rear ventilation gap is omitted since the outer protective layer is arranged directly on the second thermal insulation elements. Conventional building panels, which will be described in more detail below, are suitable as mounting plates.

It has proven to be advantageous if the retaining device comprises a plurality of spacers having a first end and a second end and a retaining rail, wherein the first end is designed for fixing to the outer wall and the second end is designed for attaching the retaining rail. The length of the spacers substantially matches the thickness of the first thermal insulation panels. The first thermal insulation panels can be arranged between an upper and a lower, adjacent spacer and are held on the outer wall of a building by the spacers and the back of the retaining rails. An arrangement of this kind on the outer wall of a building can be made very quickly without the first thermal insulation elements having to also be attached to the outer wall of a building.

In another embodiment the second end of the spacer has a slot into which the retaining rail can be pushed. The slot makes it possible for the retaining rail to be continuously pushed into the spacer to different extents. The spacing of the retaining rail from the outer wall of a building can be adjusted very flexibly therefore. This spacing can be adjusted to first thermal insulation panels having different thicknesses. Irregularities in the outer wall of a building, different spacer lengths and differences in the thickness of the thermal insulation panels can also be compensated by this constructional feature by pushing the retaining rail to different depths into slots of adjacent spacers.

Because the retaining rail is held in the slot by positive or non-positive fit, it is reliably held on the spacer once a desired position has been chosen in the slot. The position of the retaining rail in the slot can also still be changed afterwards.

A screw is advantageously screwed in at the second end of the spacer, and when screwed in this projects into the slot, whereby the retaining rail is connected to the spacer with non-positive fit. The above, non-positive retaining device has a simple structure and holds the retaining rail in the slot with millimeter accuracy. Adjustment can be made easily and quickly by fixing the retaining rail in the slot in the desired position by turning the screw. It is understood that an internal thread has to be provided at the second end of the spacer so the screw can reduce the internal width of the slot. The slot requires an internal width which is slightly larger than the thickness of the part of the retaining rail which is pushed into the slot.

In a further embodiment the retaining rail has a leg for introduction into the slot and a web that connects to the leg for attaching the mounting plate. The retaining rail is preferably designed as a T-profile since this kind of profile has a leg and a web. Since the web extends upwards and downwards from the leg, a retaining rail holds an upper and a lower thermal insulation element simultaneously.

The mounting plates are expediently attached to the retaining rail by connecting elements. These can be nails or screws. Mounting is quickest if the mounting plates are nailed to the retaining nail using a nail gun. Since the mounting plates are attached to at least two retaining rails located one above the other and join the retaining rails together, the bending strength of the retaining devices is improved by the mounting plates.

It has proven to be advantageous if the second thermal insulation elements are attached to the mounting plates with connecting elements. Since the second thermal insulation faces have a relatively high rigidity, they may also be arranged particularly quickly using a nail gun on the mounting surface, formed by mounting plates arranged side by side. The nails can be driven into the second thermal insulation elements at any points since the mounting plates located therebelow do not have preferred nail positions.

The first and second ends of the spacer are advantageously connected by a central web which has reduced thermal conductivity in order to avoid thermal bridges. A wide variety of plastics materials, which have sufficient rigidity values and low thermal conductivity, are therefore conceivable as material for the central web. Undesirable thermal bridges, which would allow moisture to form on the outer wall of a building, can be prevented by appropriate central web material.

In another embodiment the central web cross-sections are substantially vertically oriented and the retaining rails are substantially horizontally oriented in the spacers. The orientation of the central web cross-sections means that the retaining device has a high bending strength with respect to weight loads. The weight of the facade construction bends the retaining device to only a slight extent. The horizontally oriented retaining rails connect a plurality of horizontally adjacent spacers and consequently increase the stability of the retaining device.

The mounting plates are preferably made of plastics material or wood since these materials can be attached securely with nails, are sufficiently stable and are not too heavy for the retaining device.

It has proven to be advantageous if the second thermal insulation elements have a density whose upper value is 150 kg/m3, preferably 130 and particularly preferably 100 kg/m3 and whose lower value is 50 kg/m3, preferably 60 kg/m3 and particularly preferably 70 kg/m3 and the first thermal insulation elements have a density whose upper value is 90 kg/m3, preferably 70 and particularly preferably 60 kg/m3 and whose lower value is 20 kg/m3, preferably 30 kg/m3 and particularly preferably 35 kg/m3. The different densities of the first and second thermal insulation elements means that very good insulation values can be achieved with relatively low weights and thicknesses of the thermal insulation elements. The density of the second thermal insulation panels is sufficiently high for them to be attached to the mounting surface with nails without the nails being pulled out in the second thermal insulation elements.

The protective layer (51) can expediently be directly applied to the free surface of the second thermal insulation elements, wherein the protective layer comprises a reinforcing layer. In a thermal insulation composite system, the protective layer provides the requisite protection from rain, moisture and mechanical effects and is therefore necessary in the facade construction according to the invention. A reinforcing mesh is plastered into the render as reinforcement.

In a further embodiment the second thermal insulation elements are attached to the mounting plates with nails. The second thermal insulation elements have sufficient rigidity or density so the nails are not pulled out, and the second thermal insulation elements are reliably held on the mounting plates. Since the mounting plates together form a closed mounting surface, the nails can be driven regardless into the second thermal insulation elements at preferred points into the mounting plates. The nails are preferably set (shot) with a nail gun, whereby the second thermal insulation panels can be attached particularly quickly.

As already described above, it is advantageous if the mounting plates can also be attached to the retaining rails with nails, preferably with a ballistic design of the nail head, from the nail gun. The facade construction can therefore be assembled particularly quickly and easily with the aid of a nail gun. The nails have grooves to improve retention in the retaining rails.

A further aspect of the invention relates to a method for assembling the facade construction described above. It is advantageous that the facade construction can be assembled particularly quickly. The retaining device can be quickly adjusted to the thickness of the first thermal insulation elements since the retaining rails can be adjustably attached in slots of the second ends of the spacers. The mounting plates are "shot" onto the supporting rails and the second thermal insulation elements onto the mounting plates. Within the context of this application "shot attachment" should be taken to mean nailing an item on with the aid of a nail gun.

BRIEF DESCRIPTION OF THE DRAWINGS

Further advantages and features emerge from the following description of an exemplary embodiment of the invention with reference to the schematic diagrams. In drawings that are not to scale.

DETAILED DESCRIPTION OF THE INVENTION

Figure 1:
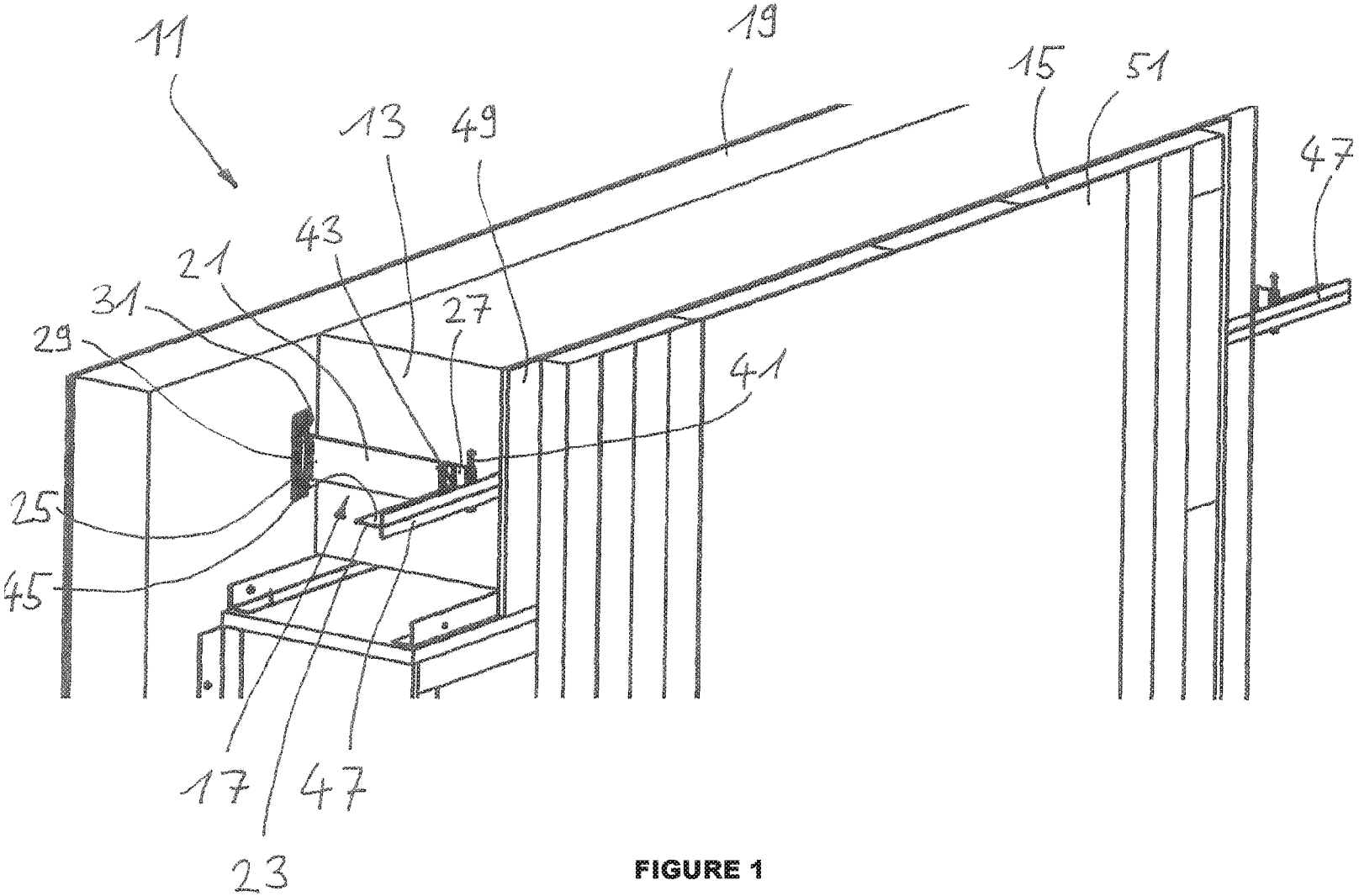
FIG. 1 shows an axonometric diagram of a facade construction according to the invention.
Figure 2:
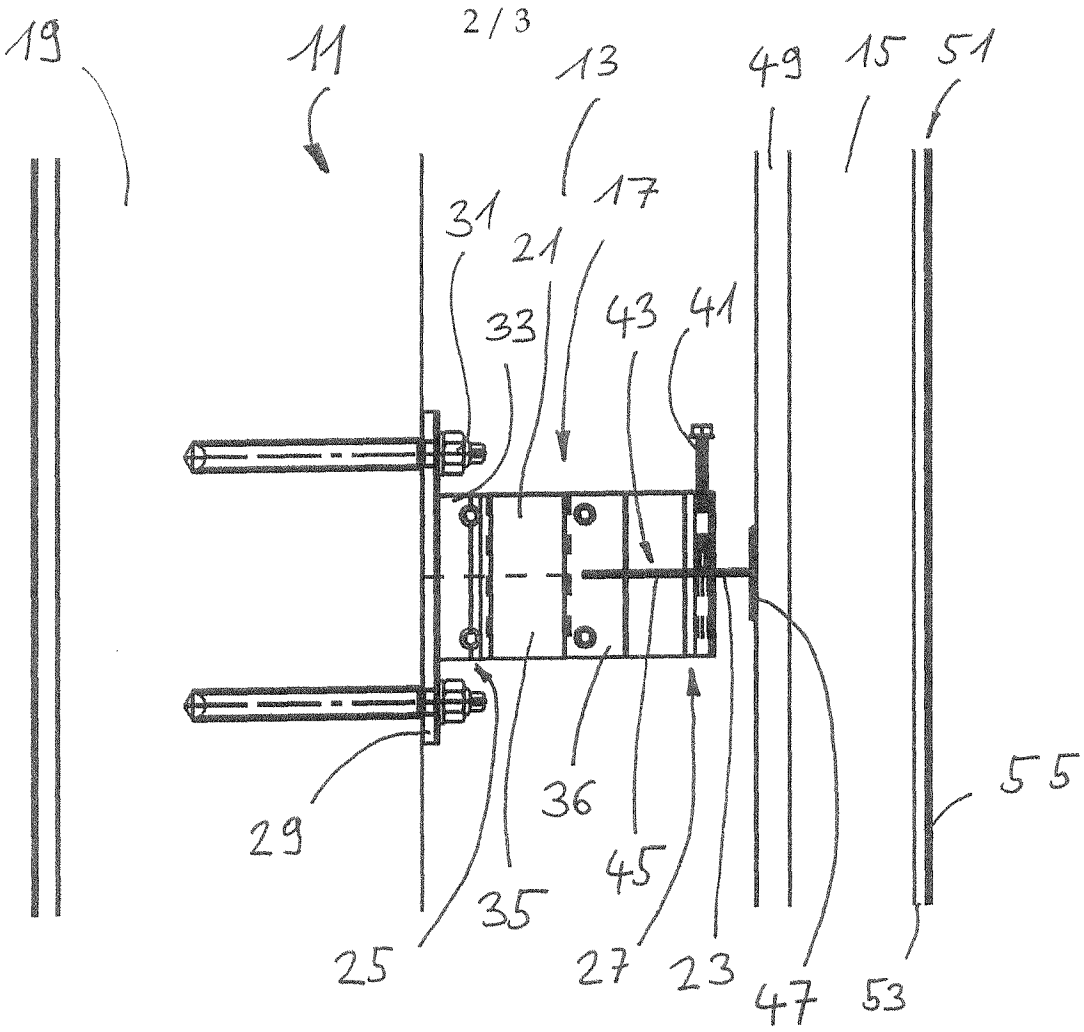
FIG. 2 shows a side view of the facade construction of FIG. 1
Figure 3:
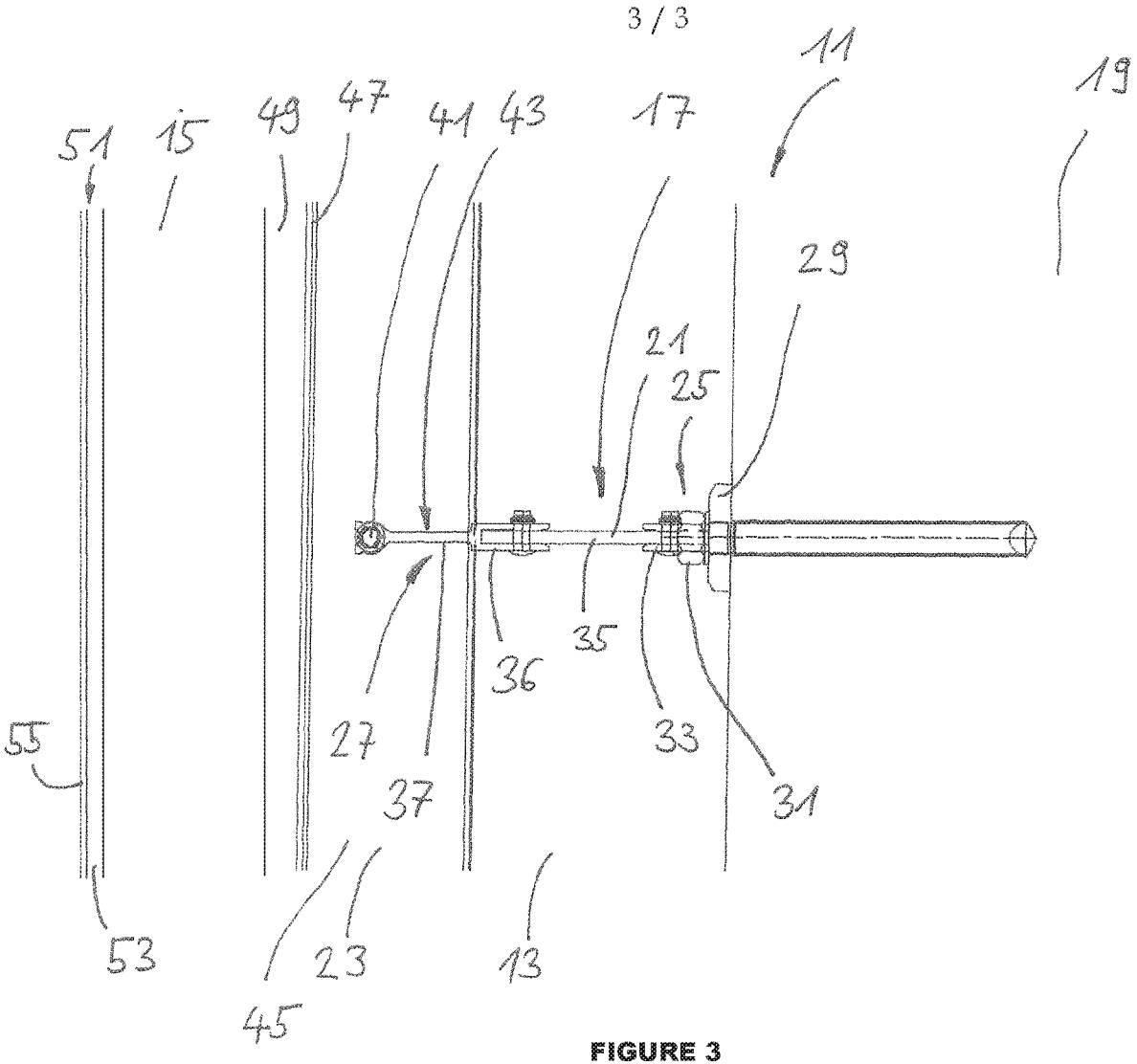
FIG. 3 shows a plan view of the facade construction of FIG. 1.

The facade construction shown in FIGS. 1 to 3 is designated as a whole by reference numeral 11. The facade construction 11 according to the invention has particularly good thermal insulation since it comprises first and second thermal insulation elements 13, 15 which are arranged one behind the other. The first thermal insulation elements 13 are held by a retaining device 17 directly on an outer wall 19 of a building. The retaining device 17 comprises a plurality of spacers 21 and retaining rails 23. The number of spacers 21 per $m^2$ of outer wall 19 is guided by the total weight of the facade construction 11 and is between 0.4 and 3 units and preferably between 0.6 and 2 units per $m^2$.

The spacer 21 has a first end 25 that faces the outer wall 19, and a second end 27 that faces away from the outer wall 19. The first end 25 has a base element 29. The base element 29 is expediently elongate and comprises two through-openings (covered by screws 31 in the figures). The base element 29 or the entire spacer 21 is attached to the outer wall 19 with the screws 31 by a screw-wall plug connection. The spacer 21 is substantially vertically oriented in order to have an optimally high bending moment in the vertical direction. The through-openings are preferably formed as slots so the spacer 21 can be oriented on the outer wall 19 along the vertical. A first U-profile 33 is formed or shaped on the base element 29. A central web 35 is received in the U-profile 33 and connected, for example riveted, to the U-profile 33. The central web 35 is also connected, for example riveted, to the second end 27. The second end 27 is also formed as a second U-profile 36 into which the central web 35 is inserted.

The second end 27 tapers to an end web 37 at which an internal thread 39 for receiving a clamping screw 41 is formed. Also provided at the end web 37 is a slot 43 into which the clamping screw 41 projects when it is tightened.

The retaining rail 23 comprises a leg 45 and a mounting web 47 that adjoins the leg 45 preferably at a right angle. The leg 45 can be introduced into the slot 43 to different depths and then be fixed in the slot 43 with the clamping screw 41. The spacing between outer wall 19 and mounting web 47 can be continuously adjusted as a result. First thermal insulation elements 13 with different thicknesses can therefore be held between the outer wall 19 and the mounting plate 49. Once all retaining devices 17 are mounted on the outer wall 19 and the spacing between the outer wall 19 and the mounting web 47 has been adjusted to the thickness of the first thermal insulation elements 13 to be mounted, the first thermal insulation elements 13 can be mounted quickly. The first thermal insulation elements 13 should be folded between upper and lower, adjacent horizontal mounting webs 47. This can be done without tools and without additional retaining means.

The mounting webs 47 fulfil a second function. On the one hand, the first thermal insulation panels 13 are held on their inner sides and, on the other hand, their outer sides are used as mounting surfaces for a plurality of mounting plates 49. The mounting plates 49 can be designed as chipboard panels, i.e. produced from wood, but also from plastics material. The mounting plates 49 are nailed or screwed onto the mounting webs 47. If the mounting plates 49 are placed flush, i.e. end to end, on the retaining rails, a planar mounting surface results for placement of the second thermal insulation elements 15 (thermal insulation panels).

The second thermal insulation elements 15 are more compact and have a higher density than the first thermal insulation elements 13. Since the second thermal insulation elements 15 are relatively firm, they can be nailed (shot) or screwed onto the mounting surface comprising mounting plates 49. The second thermal insulation elements 15 can be mounted on the plane mounting surface very quickly since the thermal insulation elements 15 do not have to be hung on the substructure, and nor do other conditions of the substructure have to be heeded.

A protective layer 51 can be directly applied to the plane surface of the assembled second thermal insulation elements 15. In a known manner a base render 53 is firstly applied for this purpose, in which a mesh (reinforcement fabric) is inserted for rigidity reasons. A final render 55 is then applied to the base render. The protective layer protects the facade construction 11 and, in particular, the second thermal insulation elements 15 from external weather effects and gives the facade construction the desired external appearance.

The method for assembling the facade construction 11 on an outer wall of a building 19 comprises the following steps in chronological order. The spacers 21 are attached, in particular screwed on, to the outer wall of a building 19 with their first ends 25 (base elements 29). The spacers 21 can be adjusted in the vertical direction by the slots provided on the base elements 29. The spacers 21 should be arranged in horizontal rows. The vertical spacings of the horizontal rows substantially match the length of the first thermal insulation panels 13. The cross-section of the central webs 35 should be vertically oriented so the central webs 35 have good bending stiffness in the vertical direction, i.e. in the direction of gravity.

The slots 43 of the horizontal rows of spacers should be oriented in a horizontal line. The leg 45 of a retaining rail 23 is pushed into the slot 43 and, more precisely, to the extent that the spacing of the mounting webs 47 from the outer wall of a building 19 substantially matches the thickness of the first thermal insulation panels 13. The retaining rail 23 is then fixed in the slots 43 by tightening the screws 31.

The first thermal insulation panels 13 can be hung between retaining rails 23 located one above the other. The first thermal insulation panels 13 are held on the outer wall of a building 19 by the backs of the mounting webs 47 and do not require any further fastening measures. The first thermal insulation panels 13 can accordingly be quickly attached to the outer wall of a building 19.

A plurality of mounting plates 49 is attached to the outer side of the mounting webs 47, preferably nailed on using a nail gun. The mounting plates 49 can also be attached quickly. The mounting plates 49 attached side by side form a closed mounting surface.

It is owing to the closed mounting surface, formed by the mounting plates 49, that the second thermal insulation panels 15 can be quickly nailed to the mounting plates 49, in particular using a nail gun. It is not necessary to ensure that the nails strike a particular region of the mounting plates 49 since the mounting plates 49 have the same rigidity properties at all points.

The density or rigidity of the second thermal insulation panels 15 is sufficient for the nails that are used (staples or screws are also conceivable) not to be pulled out. If staples are used they can be driven through the second thermal insulation panels 15 into the mounting plates 49 by an electric tacker or a pneumatic tacker.

For example, base render 53 with mesh reinforcement and a final render 55 are applied to the second thermal insulation panels 15.

The invention claimed is:

1. A facade construction, comprising:

first thermal insulation elements having a first density arranged on a outer wall of a building of an outer wall of a building;

second thermal insulation elements having a second density arranged on the first thermal insulation elements and having a second density that is greater than the first density of the first thermal insulation elements;

a retaining device arranged on the outer wall of a building and holding the first and second thermal insulation elements on the outer wall of a building;

a protective layer that protects the second thermal insulation elements against environmental influences; and an intermediate layer in the form of a plurality of mounting plates, the intermediate layer attached to and supported by the retaining device, wherein the second thermal insulation elements are arranged on the mounting plates and the first thermal insulation elements contact the outer wall of a building and on the intermediate layer such that the facade construction is substantially free from rear ventilation, wherein the plurality of mounting plates are attached side by side on the retaining device and form a continuous and planar mounting surface for the second thermal insulation elements and wherein the mounting plates are sandwiched between the first thermal insulation and the second thermal insulation.

2. The facade construction of claim 1, wherein the retaining device comprises a plurality of spacers each having a first end and a second end and a retaining rail, wherein the first end is designed for fixing to the outer wall of a building and the second end is designed for attaching the retaining rail.

3. The facade construction of claim 2, wherein the second end of each of the plurality of spacers has a slot into which the retaining rail is insertable.

4. The facade construction of claim 3, wherein the retaining rail is held in the slot by a positive or non-positive fit.

5. The facade construction of claim 3, wherein the retaining rail has a leg for introduction into the slot and a web that connects to the leg for attaching the mounting plate.

6. The facade construction of claim 2, wherein the first end and second end of each of the plurality of spacers are connected by a central web with reduced thermal conductivity in order to avoid thermal bridges.

7. The facade construction of claim 6, wherein a cross-section of the central web is substantially vertically oriented and the retaining rail is substantially horizontally oriented and held by the corresponding spacer.

8. The facade construction of claim 1, wherein the first thermal insulation elements have a density between 90 kg/m3 and 20 kg/m3.

9. The facade construction of claim 8, wherein the first thermal insulation elements have a density between 70 kg/m3 and 30 kg/m3.

10. The facade construction of claim 9, wherein the first thermal insulation elements have a density between 60 kg/m3 and 35 kg/m3.

11. The facade construction of claim 1, wherein the second thermal insulation elements have a density between 150 kg/m3 and 50 kg/m3.

12. The facade construction of claim 11, wherein the second thermal insulation elements have a density between 130 kg/m3 and 60 kg/m3.

13. The facade construction of claim 11, wherein the second thermal insulation elements have a density between 100 kg/m3 and 70 kg/m3.

14. The facade construction of claim 1, wherein the protective layer can be directly applied to the free surface of the second thermal insulation elements and wherein the protective layer comprises a reinforcing coat.

15. The facade construction of claim 2, wherein the mounting plates are fixedly attached to the retaining rails.

16. The facade construction of claim 1, wherein the second thermal insulation elements are fixedly attached to the mounting plates.

17. A method for assembling a facade construction, comprising:

attaching a plurality of spacers to a outer wall of a building, each of the spacers having a first end and a second end with the first ends of the spacers in horizontal rows, wherein a vertical spacing of the horizontal rows substantially match a length of first thermal insulation panels;

inserting a plurality of retaining rails into a corresponding plurality of slots provided at the second ends of the spacers of the horizontal rows of spacers;

clamping the retaining rails with tightening screws that project into the slots to the extent that the spacing of the retaining rails from the outer wall of a building substantially matches the thickness of first thermal insulation panels;

hanging first thermal insulation panels between retaining rails located one above the other;

attaching a plurality of mounting plates to an outer side of the retaining rails with fastening elements; and fixedly attaching a plurality of second thermal plates to the plurality of plates along a continuous and planar mounting surface formed by the mounting plate.

* * * * *